US012049796B2

(12) United States Patent
Robertson et al.

(10) Patent No.: US 12,049,796 B2
(45) Date of Patent: Jul. 30, 2024

(54) CROWN PLUG SECUREMENT SYSTEM

(71) Applicant: Plexus Ocean Systems Limited, Aberdeen (GB)

(72) Inventors: Michael Robertson, Aberdeen (GB); Richard Arthur, Aberdeen (GB); Craig Hendrie, Aberdeen (GB); Brent Harrald, Aberdeen (GB); Steve Rizza, Aberdeen (GB); Jinde Hao, Aberdeen (GB)

(73) Assignee: Plexus Holdings PLC, Aberdeen (GB)

( * ) Notice: Subject to any disclaimer, the term of this patent is extended or adjusted under 35 U.S.C. 154(b) by 0 days.

(21) Appl. No.: 17/769,240

(22) PCT Filed: Oct. 15, 2020

(86) PCT No.: PCT/GB2020/052604

§ 371 (c)(1),
(2) Date: Apr. 14, 2022

(87) PCT Pub. No.: WO2021/074633

PCT Pub. Date: Apr. 22, 2021

(65) Prior Publication Data

US 2023/0125713 A1 Apr. 27, 2023

(30) Foreign Application Priority Data

Oct. 16, 2019 (GB) ..... 1914978

(51) Int. Cl.
*E21B 33/03* (2006.01)
*E21B 33/035* (2006.01)

(52) U.S. Cl.
CPC ..... *E21B 33/03* (2013.01); *E21B 33/0353* (2020.05)

(58) Field of Classification Search
CPC ..... E21B 33/03; E21B 33/0353
See application file for complete search history.

(56) References Cited

U.S. PATENT DOCUMENTS 2,857,004 A * 10/1958 Bethancourt ..... E21B 33/12 166/99
4,804,045 A * 2/1989 Reed ..... E21B 33/0407 166/313
6,662,868 B1 * 12/2003 Van Bilderbeek .... E21B 33/038 166/89.1

(Continued)

*Primary Examiner* — D. Andrews
(74) *Attorney, Agent, or Firm* — Calderon, Safran & Wright P.C.

(57) ABSTRACT

A crown plug for a tree of an oil/gas well/wellhead has a securement arrangement for securing the crown plug within the tree. The main body of the crown plug comprises a solid body creating the barrier within the production bore. The solid body creates a robust, strong and reliable barrier. The crown plug is retained within the outer member through inward distortion which secures the crown plug. The securement arrangement arises from an inward radial force that distorts the outer member inwardly to grip a component located within the outer member. The outer member elastically deforms and the outer member returns to a released position once the clamping force is released. Two concentric oppositely arranged tapered surfaces move axially to create the inwardly directed force. The clamping force and the solid body together provide an improved crown plug which is easy and reliable to operate.

18 Claims, 4 Drawing Sheets

(56) References Cited

U.S. PATENT DOCUMENTS

| | | | | |
|---|---|---|---|---|
| 2004/0163821 | A1 | 8/2004 | Van Bilderbeek | |
| 2005/0139360 | A1 | 6/2005 | Van Bilderbeek | |
| 2011/0300008 | A1 | 12/2011 | Fielder et al. | |
| 2012/0043089 | A1 | 2/2012 | Hoffman et al. | |
| 2018/0313180 | A1* | 11/2018 | Sommerfeld | E21B 23/02 |

* cited by examiner

CROWN PLUG SECUREMENT SYSTEM

CROSS-REFERENCE TO RELATED APPLICATIONS AND CLAIM TO PRIORITY

This application is a national stage application of International Application No. PCT/GB2020/052604 filed Oct. 15, 2020, which claims priority to United Kingdom Patent Application No. 1914978.0 filed Oct. 16, 2019, the disclosures of which are incorporated herein by reference and to which priority is claimed.

FIELD OF THE INVENTION

The present invention relates to a crown plug securement system and a method of securing a crown plug within a bore.

BACKGROUND TO THE INVENTION

Crown plugs are used in oil and gas production to seal the production bore of horizontal Christmas trees in both surface and subsea applications. In particular, crown plugs fit into a bore of a subsea tree and forms a barrier against reservoir pressure. It is essential that the crown plug can be removed to allow access for downhole operations when required. Conventional plugs can be problematic due to number or moving parts and the method to operate.

In petroleum and natural gas extraction, a Christmas tree generally comprises an assembly of valves, spools, and fittings used to regulate the flow within pipes/conduits in an oil well, gas well and other wells. The Christmas tree may simply be referred to as a tree and, can be more specifically defined as either a subsea tree or a surface tree. The tree and a wellhead are related but generally separate items/assemblies of apparatus/equipment and the tree is generally installed on top of the wellhead.

There are two main types of Christmas trees used in oil and gas production, vertical and horizontal. On vertical Christmas trees, the valves are positioned in line with the wellbore, but on horizontal Christmas trees, the valves are positioned at 90° to the wellbore. To provide a barrier to the environment, horizontal Christmas trees require crown plugs to be set in the wellbore above the production outlets. The crown plug(s) must seal and withstand pressure from production fluids.

The crown plugs must be removable to permit downhole operations which may be performed throughout the duration of the well. Conventional crown plugs can be difficult to set and can become stuck, requiring excessively large force to unstick and retrieve. For example, crown plugs may include latch or dog mechanisms which are required to move and function correctly. Accordingly, crown plugs typically include multiple moving parts. These mechanisms include individual elements and components which may be independently moved and operated in order to set and release the crown plug. The difficulties in releasing and retrieving crown plugs can cause delays to downhole operations which thereby has significant cost implications.

When such crown plugs become stuck or problems with retrieval are encountered then pressure or slickline jarring methods may be required to function the crown plug and help with the retrieval.

It is an aim of the present invention to overcome at least one problem associated with the prior art whether referred to herein or otherwise.

SUMMARY OF THE INVENTION

According to a first aspect of the present invention there is provided a crown plug securement system comprising securement means to secure a crown plug within an outer member of a bore wherein the securement means comprises a clamping arrangement which is activated between a first configuration and a second configuration wherein, in the first configuration, a clamping member is in an unclamped configuration and enables a crown plug to be axially moved within the outer member to an axial position which is aligned with the clamping member of the clamping arrangement and, in the second configuration, the clamping arrangement exerts sufficient radial force on the outer member to distort the outer member inwardly to grip the crown plug and secure the crown plug in the axial position within the bore.

Preferably the crown plug comprises a unitary (solid) component.

Preferably the crown plug comprises a one piece component.

Preferably in changing from an unclamped position to a clamped position the crown plug solely requires positioning at the clamping position without any manipulation of any elements or components (securement elements or setting components etc.) of (or located on) the crown plug.

The crown plug may solely be secured in position by the clamping arrangement. The crown plug may solely be secured in position by activation and/or movement of elements located externally of the outer member.

Preferably the crown plug comprises an outer sealing surface.

Preferably the crown plug and the outer member create a metal to metal seal in the second configuration. Preferably the crown plug and the outer member create a full circumferential metal to metal seal in the second configuration.

Preferably the outer sealing surface comprises a metal sealing surface.

Preferably the outer sealing surface comprises a resilient seal and may comprise an elastomeric seal.

Preferably the outer sealing surface comprises an O-ring seal.

The outer sealing surface may comprise two (or more) resilient seals which may be axially spaced apart. The or each resilient seal may comprise an elastomeric seal and may comprise an O-ring seal.

The outer sealing surface may comprise a profiled (contoured) sealing surface. The profiled sealing surface may comprise a series of axially spaced apart ridges and/or troughs. The profiled sealing surface may comprise a series of (full) circumferential rounded ridges or ribs (radial bumps) extending around the outer sealing surface and wherein adjacent rounded ridges may be separated by intermediate troughs or (full) circumferential recesses. Preferably each rounded ridge provides an outer sealing surface and more preferably provides a smooth curved/arcuate sealing surface which extends around the full circumference of the outer sealing surface.

The outer sealing surface may comprise a first (upper) array of rounded ridges and a second (lower) array of rounded ridges. The first array of rounded ridges may locate on an upper portion of (the sealing surface of) the crown plug and may locate above a sealing member (elastomeric seal). The second array of rounded ridges may locate on a lower portion of (the sealing surface of) the crown plug and may locate below a sealing member (elastomeric seal).

The profiled sealing surface may comprise a second series of axially spaced apart ridges and/or troughs. The profiled sealing surface may comprise a series of (full) circumferential angled ridges or ribs (gripping teeth) extending around the outer sealing surface and wherein adjacent angled ridges may be separated by intermediate troughs or (full) circumferential recesses. Preferably each angled ridge provides an outer gripping surface and more preferably provides an angled gripping surface which extends around the full circumference of the outer sealing surface.

The outer sealing surface may comprise a first (upper) array of angled ridges and a second (lower) angled of rounded ridges. The first array of angled ridges may locate on an upper portion of (the sealing surface of) the crown plug and may locate above a sealing member (elastomeric seal). The second array of angled ridges may locate on a lower portion of (the sealing surface of) the crown plug and may locate below a sealing member (elastomeric seal).

Preferably the outer member comprises an index shoulder which is arranged, in use to cooperate with an index surface (shoulder) on the crown plug in order to align the crown plug relative to the clamping arrangement.

The index surface of the crown plug may be provided by a lower annular surface which may be provided around a lower outer edge of the crown plug.

The index surface of the crown plug may be provided by an upper annular surface which may be provided around an upper outer edge of the crown plug.

The crown plug may comprise a tapered main body.

An outer sealing surface of the crown plug may be tapered. The tapered outer sealing surface of the crown plug may be arranged to cooperate with a respective tapered portion of the bore (of the outer member).

The main body may be tapered downwardly from an upper end to a lower end.

The crown plug may comprise a main body. Preferably the main body is arranged to create a barrier across the outer member. Preferably the main body comprises a solid body. Preferably the solid body provides a plug or bung which fills the outer member within a sealing zone and wherein the sealing zone extends along an axial length of the outer member.

The crown plug may comprise a tool attachment member. The tool attachment member may be located on an upper surface of the crown plug and preferably on an upper surface of the main body of the crown plug.

The tool attachment member may comprise a lug extending upwardly (away) from an upper surface of the main body. The lug may comprise a neck portion and a head portion. The neck portion may provide an annular space into which a part of a running tool may extend and engage the head in order to enable the crown plug to be moved axially within the outer member.

The tool attachment member may comprise a recess extending inwardly into the crown plug. The recess may an engagement groove into which a part of a running tool may extend and engage the crown plug in order to enable the crown plug to be moved axially within the outer member.

Once attached, the running tool may be able to retrieve the crown plug following unclamping of the crown plug.

The crown plug may comprise a running profile. The running profile may enable a running tool to be secured thereto.

Once attached, the running tool may be able to controllably move the crown plug longitudinally in both (opposing axially/longitudinally extending) directions following unclamping of the crown plug.

Preferably the securement means secures the crown plug in a first longitudinal direction and in an opposite second longitudinal direction in order to prevent movement of the crown plug in either longitudinal direction.

Preferably in the first position an outer sealing surface of the crown plug is arranged to locate at a longitudinal position in which an outer sealing surface is movable relative to an inner surface provided in the outer member in order to enable the crown plug to move within the outer member.

Preferably in the first position an outer sealing surface of the crown plug is arranged to locate at a longitudinal position in which an outer sealing surface is spaced apart from an inner surface provided in the outer member in order to enable the crown plug to move freely within the outer member.

Preferably the outer sealing surface comprises an outer metal surface to create a metal to metal seal in the second position.

The outer sealing surface may comprise an O-ring seal and preferably comprises two O-ring seals longitudinally spaced apart on the outer surface of the crown plug.

Preferably the clamping arrangement comprises a collar having an externally tapered surface, the arrangement may also include an annular component with an internally tapered surface. The collar and the annular component may be relatively axially moveable between a first position in which the tapered surface of the annular component exerts no radial force on the collar and a second position which the tapered surface of the annular component exerts sufficient radial force to distort the collar inwardly to grip the crown plug.

Preferably the annular component comprises a compression ring.

Preferably the collar comprises a compression collar.

The compression collar may have an axially extending groove provided on the outer periphery and preferably the compression collar has a plurality of axially extending grooves provided radially around the outer periphery.

Preferably the arrangement includes an outer member which is arranged, in use, to locate between an inner surface of the collar and an outer surface of the crown plug.

Preferably the outer member comprises a surface casing which extends upwardly towards the sea surface.

Preferably the outer member comprises a surface casing which extends downwardly towards a field and preferably below the mudline.

Preferably the outer member comprises a compression sleeve.

Preferably the arrangement includes movement means for moving the annular component relative to the collar. Preferably the movement means comprises hydraulic movement means.

The movement means may comprise a chamber between the annular component and the upper clamping housing component, and the chamber may be pressurised to urge the annular component away from the upper clamping housing component. The clamping arrangement may comprise hydraulic fluid introduction means to introduce hydraulic fluid into the chamber in order to urge the annular component away from the upper clamping housing component.

The movement means may comprise a piston. Preferably the movement means comprises a plurality of pistons. Preferably the pistons are arranged radially around the annular component.

The or each piston may be mounted on a clamping housing and preferably on an upper clamping housing component. Preferably the upper clamping housing component is mounted to a lower end of a conductor which extends upwardly towards the sea surface. The or each piston may be arranged to extend downwardly from the clamping housing and to move the collar downwardly away from the clamping housing.

The sleeve is preferably a component which may be either threaded onto a casing or may be located in a suitable locating and receiving area on the casing.

The clamping arrangement may comprise locking means to lock the annular component in the second position. The locking means may comprise a locking member which engages in a locking recess provided in a lower clamping housing component. Preferably the locking means comprises a plurality of locking members.

The locking member may comprise a locking finger.

The locking finger may comprise a resilient component that is inherently urged into engagement with the locking recess at the locking position or when the annular component reaches the second position.

The locking means may comprise lock release means. Preferably the lock release means is arranged to disengage the or each locking member from the locking recess.

The lock release means may comprise movement means to move the locking member out of engagement with the locking recess. The lock release means may comprise a piston and preferably comprises a hydraulic piston.

The clamping arrangement may comprise return movement means to move the annular component from the second position towards the first position. In particular, the return movement means may aid the release of the clamping force from between the annular component and the collar.

Preferably the return movement means comprises a chamber between the annular component and the lower clamping housing component, and the chamber may be pressurised to urge the annular component away from the lower clamping housing component.

The movement means may comprise a piston. Preferably the movement means comprises a plurality of pistons. Preferably the pistons are arranged radially around the annular component.

The or each piston may be mounted on a lower clamping housing component. Preferably the lower clamping housing component is mounted to an upper end of a conductor which extends downwardly away from the sea surface and/or below the mudline. The or each piston may be arranged to extend upwardly from the lower clamping housing component and to move the collar upwardly away from the lower clamping housing component.

Preferably the clamping arrangement comprises a subsea clamping arrangement.

Preferably the subsea wellhead provides a well extending in a longitudinal direction from a first upper end to a second lower end.

The clamping arrangement may be arranged to exert sufficient radial force to distort the outer member (sleeve) inwardly to grip the crown plug.

Preferably the sleeve is arranged, in use, to locate between an inner surface of a part of the clamping arrangement and an outer surface of the crown plug.

Preferably the sleeve comprises a cylindrical section of a casing including an inner surface and an outer surface.

According to a second aspect of the present invention there is provided a tree including a securement arrangement for securing a crown plug within the tree, the securement arrangement being in accordance with the first aspect of the present invention.

According to a third aspect of the present invention there is provide a method of securing a crown plug within a tree comprising activating securement means to secure the crown plug within an outer member of a bore wherein the securement means comprises a clamping arrangement, the method comprising activating the clamping arrangement between a first configuration and a second configuration wherein, in the first configuration, a clamping member is in an unclamped configuration and enables the crown plug to be axially moved within the outer member to an axial position which is aligned with the clamping member of the clamping arrangement and, in the second configuration, the clamping arrangement exerts sufficient radial force on the outer member to distort the outer member inwardly to grip the crown plug and secure the crown plug in the axial position within the bore.

BRIEF DESCRIPTION OF THE DRAWINGS

The present invention will now be described, by way of example only, with reference to the drawings that follow, in which.

DESCRIPTION OF THE PREFERRED EMBODIMENTS

The present invention relates to a crown plug 10 for a tree (Christmas tree) of/associated with an oil/gas well/wellhead and a securement arrangement 50 for securing the crown plug 10 within the tree. In particular, the crown plug 10 provides a simple structural arrangement which can be reliably and easily secured and retrieved from the tree. In addition, the securement arrangement 50 reliably secures the crown plug 10 within the tree and provides a consistently reusable system for securing the crown plug 10. Furthermore, the securement automatically provides a full circumferential metal to metal seal between the crown plug 10 and the tree conduit/bore.

The securement arrangement comprises a clamping arrangement 50 by which an inward radial force is generated in order to distort (deflect/compress) an outer member 30 inwardly in order to grip a component located within the outer member 30. The outer member 30 is elastically deformed such that the outer member 30 will return to a released position once the clamping force is released/removed. In the preferred embodiment, two concentric oppositely arranged tapered surfaces are arranged to move axially over each other to create the inwardly directed force. Examples of such clamping arrangement will be described later.

Figure 1:
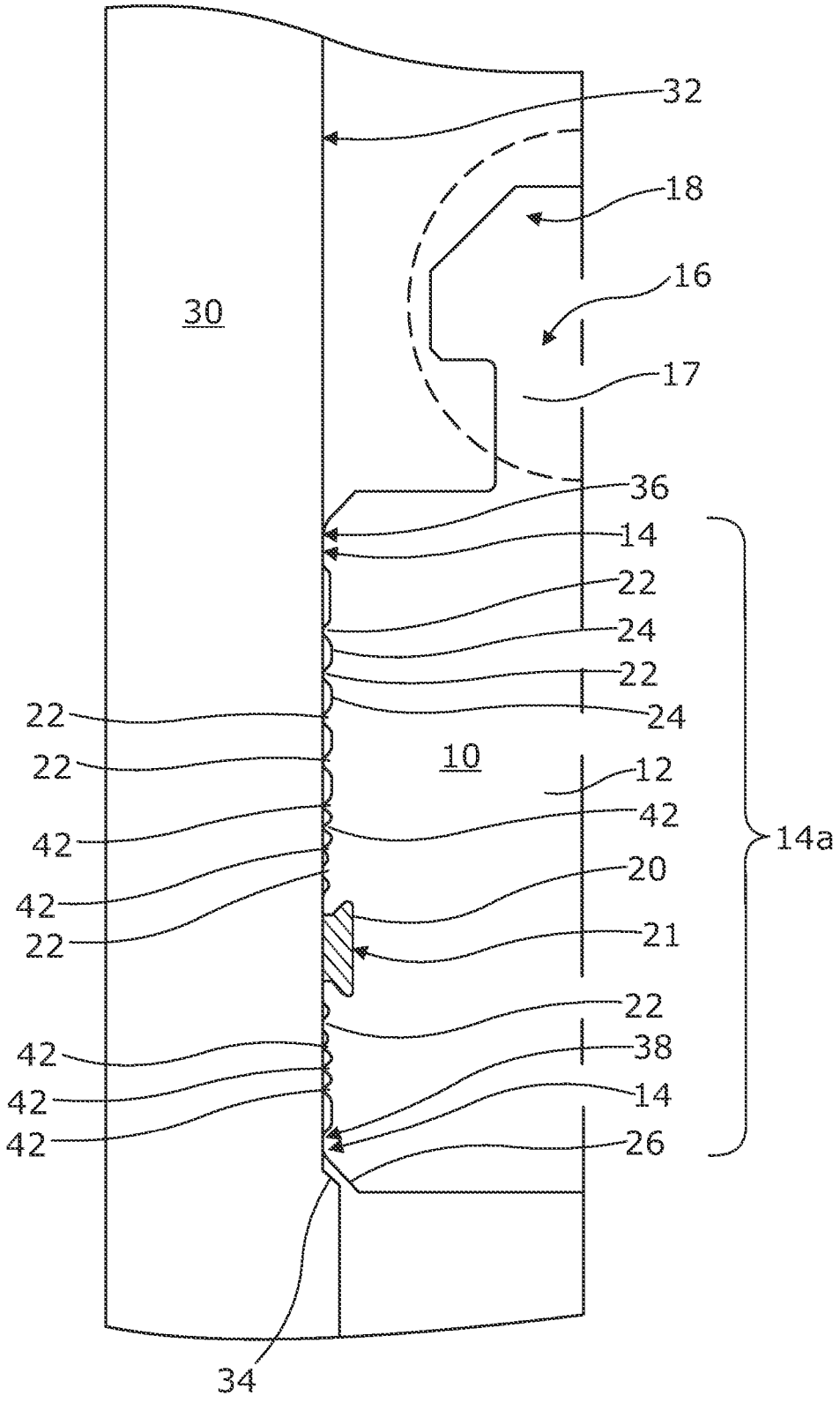
FIG. 1 is a cross section of a part of a crown plug located within an outer member.

As shown in FIG. 1, the crown plug 10 comprises a main body 12 which provides an outer sealing surface 14 which, when set/secured, is arranged to create a metal to metal seal within the production bore of a (subsea or surface) horizontal Christmas tree. The span 14*a* or axial extent of the sealing surface is shown in FIG. 1. In use, the crown plug 10 is arranged to locate within an outer member 30 of the tree. This outer member 30 may be a tubing hanger neck, Christmas tree cap or Christmas tree body.

The outer member 30 comprises a tube which extends downwardly, i.e. from the sea surface towards (or beyond) the mudline and forms a part of the production bore of a horizontal Christmas tree. The outer member 30 comprises an inner cylindrical surface 32.

The crown plug 10 is arranged to be moved into a securement position by moving the crown plug 10 axially within the outer member 30. Similarly, the crown plug 10 is arranged to be retrieved by moving the crown plug 10 axially upwardly within the outer member 30 to an exit position. Accordingly, the outer profile of the crown plug 10 fits within the inner diameter defined by the outer member 30. This thereby allows the free movement of the crown plug 10 upwardly and downwardly within the outer member 30. This free movement prevents damage to the outer surface of the crown plug 10 and preserves the integrity of the crown plug 10 and the associated sealing surface 14 during transit.

The movement of the crown plug 10 is controlled through the engagement of the crown plug 10 with an elongate line to which the crown plug 10 is attached. In particular, a running tool engages the crown plug 10 and wherein the running tool comprises (is provided on) a slickline for positioning and retrieving the crown plug 10.

The crown plug 10 provides an attachment member 16 to which the running tool can attach. The attachment member 16 is provided on an upper surface of the crown plug 10. This attachment member 16 comprises a neck portion 17 and a head portion 18.

The attachment member 16 may be in the form of a lug with a general mushroom shape such that the head portion 18 can be easily and reliably engaged and released by the running tool. The neck portion 17 provides a space underneath the enlarged head portion 18 which enables the head portion 18 to be securely engaged. This engagement then enables the crown plug 10 to be retrieved by pulling up on the slickline or the crown plug 10 can move in a controlled descent with the aid of gravity whilst suspended from the slickline.

The attachment member 16 is provided on an upper surface of the main body 12 of the crown plug 10. The main body 12 of the crown plug 10 comprises a solid body to create the barrier within the production bore. The solid body thereby creates a robust, strong and reliable barrier. In particular, the combination of the clamping (squeeze) securing force together with the solid body provides an improved crown plug arrangement which is also easy and reliable to operate.

The crown plug 10 is retained within the outer member 30 through the distortion of the outer member 30 inwardly which thereby grips and clamps the crown plug 10 within the bore. A crown plug lacking in a solid body may naturally distort due to such a high gripping force and the use of the solid body thereby addresses this potential problem. Accordingly, the main body 12 of the crown plug 10 is designed to withstand and utilise this high and reliable inward gripping/securing force.

Prior art crown plugs may include articulating and moving securement elements directly mounted thereon and whereby these elements are activated to secure the crown plug in position. Accordingly, this requires the activation within the bore whilst the crown plug is in position. This may require the transmission of a signal or forces down the bore. Such transmission can be difficult and problematic. Furthermore, if there is a problem with the activation of the securement system the problem can be difficult to identify, diagnose and rectify. The present invention utilises an external activation system which helps overcome any such problems.

The main body 12 of the crown plug 10 provides the sealing surface 14 for the crown plug 10. This sealing surface 14 locates around the outer periphery of the main body 12. The sealing surface 14 creates a full circumferential metal to metal seal between the crown plug 10 and the outer member 30.

The sealing surface 14 is defined around the full peripheral surface of the main body 12 and may extend axially along a longitudinal length of the main body 12. This helps to provide a sealing surface over a substantial and significant surface area rather than a relatively thin sealing surface. The sealing surface 14 extends longitudinally along the outer surface of the main body 12 from a lower end to an upper end. The sealing surface 14 is defined around the main body 12 and encloses a solid body which thereby strengthens the sealing surface 14 and inhibits or prevents significant movement (or compression) of the sealing surface inwardly which may weaken any grip formed between the crown plug 10 and the outer member 30.

As mentioned above, the sealing surface 14 includes a retaining groove 21 with an elastomeric seal 20 mounted therein. This retaining groove 21 locates between the upper end and the lower end of the sealing surface 14.

The outer surface of the crown plug 10 comprises a profiled/contoured surface. In particular, the sealing surface 14 may comprise a series of first shaped flanges/projections/contours and a series of second shaped flanges/projections/contours all of which extended around the periphery of the outer surface. The first series may create/enhance the sealing forces and the second series may create/enhance the gripping/frictional forces.

The first series may comprise a series of (radial) bumps 22 or round (smooth/arcuate) ridges/raised areas (circumferential abutments/projections) for sealing purposes and the second series may comprise a series of (angled) teeth 42 or angled ridges for gripping (frictional) purposes.

As mentioned above, the sealing surface 14 of the crown plug 10 comprises a series of radial bumps 22 (or outwardly projecting radial sealing flanges) to create and enhance the seal. These bumps or rounded ridges form peripheral (sealing) ribs extending around the crown plug 10. The radial bumps 22 comprise a series of peripheral sealing surfaces projecting outwardly from the crown plug 10 and extend around the outer surface 14 of the main body 12 of the crown plug 10. The radial bumps comprise a side profiled surface of a general sinusoidal shape including a smoothly shaped (curved) outermost portion (or peak) rather than a sharp peak or saw tooth profile.

The radial bumps 22 are spaced apart by trough regions 24 or peripheral recesses/grooves. Adjacent radial bumps 22 are evenly spaced apart but may be separated by different spacings which may be dependent upon the relative location on the sealing surface 14.

The crown plug 10 includes a first array of radial sealing bumps located axially above the elastomeric sealing member 20. The crown plug 10 may comprise one or more radial sealing bumps located (possibly in a second array) axially below the sealing member 20.

In the preferred embodiment shown in FIG. 1, there are four radial bumps 22 equally spaced apart in a first array located above the sealing member 20. These (four) radial bumps 22 effectively provide a corrugation or corrugated configuration along an axial portion of the outer sealing surface 14. In addition, there is a further radial bump 22 located adjacent to the sealing member 20. The separation distance between this radial bump 22 and the next radial bump 22 located above provides a space within which a series of gripping teeth 42 are provided.

In this embodiment (FIG. 1), a single radial bump 22 is provided below the sealing member 20 and above another series of gripping teeth 42.

The radial bumps 22 are arranged to project outwardly and contact the inner surface 32 of the outer member 30. The arrangement of the radial bumps 22 will thereby create an overall effective seal and, specifically, a number of seals and/or regions of higher sealing strength may be created by the individual radial bumps 22 with each radial bump 22 being urged and deformed inwardly by the compression of the outer member.

The crown plug 10 further provides an upper sealing region 36 and a lower sealing/contact region 38 which are respectively located at an upper end and a lower end of the crown plug 10.

As mentioned above, the sealing surface 14 comprises gripping teeth 42 to aid the grip and frictional engagement between the crown plug 10 and the outer member 30. The gripping teeth 42 comprise angled ridges extending around the periphery (circumference) of the crown plug 10. These angled ridges form peripheral (gripping) ribs extending around the crown plug 10.

In the preferred embodiment (shown in FIG. 1), the crown plug 10 comprises a first array of gripping teeth 42 located above the sealing member 20 and a second array of gripping teeth 42 located below the sealing member 20. Each array of gripping teeth 42 effectively provide a corrugation or corrugated configuration of angled ridges along an axial portion of the outer sealing surface 14. The gripping teeth 42 are essential outwardly extending projections which are provided around the full circumference of the crown plug 10. Accordingly, each of the gripping teeth 42 forms a flange/ring or band around the outer sealing surface of the crown plug 10.

The gripping teeth 42 comprise a side profile of a general saw tooth or sharp/triangular peak rather than a sinusoidal shape/smooth shape. The angular peak enhances the gripping strength and/or capability of the gripping teeth 42.

As shown in FIG. 1, the crown plug 10 the first array of gripping teeth 42 located above the sealing member 20 comprises three gripping teeth 42 which are equally spaced apart and located close to each other. Similarly, the second array of gripping teeth 42 located below the sealing member 20 are equally spaced apart and located close to each other. The crown plug 10 may also include an upper sealing surface 36 and a lower sealing surface 38. These may be located at or define the upper and lower extents of the sealing surface.

The gripping teeth 42 towards the middle and lower extent (regions) of the sealing surface 14 may be located closer to each other than the radial bumps 22 located towards the top (uppermost) of the sealing surface 14.

The radial bumps 22 provide an outermost surface through which the full circumferential metal to metal seal is created and/or facilitated when the clamping arrangement 50 is activated to cause the outer member 30 to deflect inwardly. Since the clamping arrangement 50 is an annular clamping arrangement, the outer member 30 deflects/distorts/moves inwardly in a uniform and even way in which the inner circular passageway gradually decrease in diameter. This provides a global reduction in the passageway within the outer member 30. This reduction then causes the outer member 30 to initially abut the sealing surface 14 (bumps 22/teeth 42/O-ring seal(s) 20) setting the seal and gripping the crown plug 10 within the outer member 30. The further inward reduction increases the sealing force/gripping force and grips/secures the crown plug 10 in position within the outer member 30.

The required inward deflection can be calculated by the material/size of the components (outer member 30, crown plug 10 etc.) and, therefore, the sealing force and gripping/securing force can also be predetermined and reliably set. The clamping arrangement 50 can be set up to deliver the required sealing force/gripping strength without manually adjustment during the procedure.

As shown in FIG. 1, a seal member 20 is provided on the sealing surface 14. The sealing member 20 comprises an elastomeric (resilient) seal 20 located within a retaining groove 21. In particular, the sealing member 20 comprise an O-ring seal 20 located on the sealing surface 14. This O-ring seal 20 may locate in a middle region of the sealing surface 14 between a lower region of radial bumps 22/gripping teeth 42 and an upper region of radial bumps 22/gripping teeth 42. When the outer member 30 has been deflected/distorted/moved inwardly it will be appreciated that this creates an annular sealing zone which extends longitudinally/axially between the outer surface 14 of the main body 12 and the inner surface 32 of the outer member 30.

After the clamping force is removed from the outer member 30, the outer member 30 returns to the default position and releases the seal created around the main body 12 of the crown plug 10. This then enables the crown plug 10 to be retrieved upwardly through the production bore.

The outer member 30 includes alignment means to enable the location of the crown plug 10 to be reliably set at the correct sealing position (in alignment with the clamping arrangement 50). This alignment means includes an inwardly extending flange or shoulder 34 defined on the inner surface 32 of the outer member 30. This shoulder 34 projects inwardly into the production bore.

Figure 3:
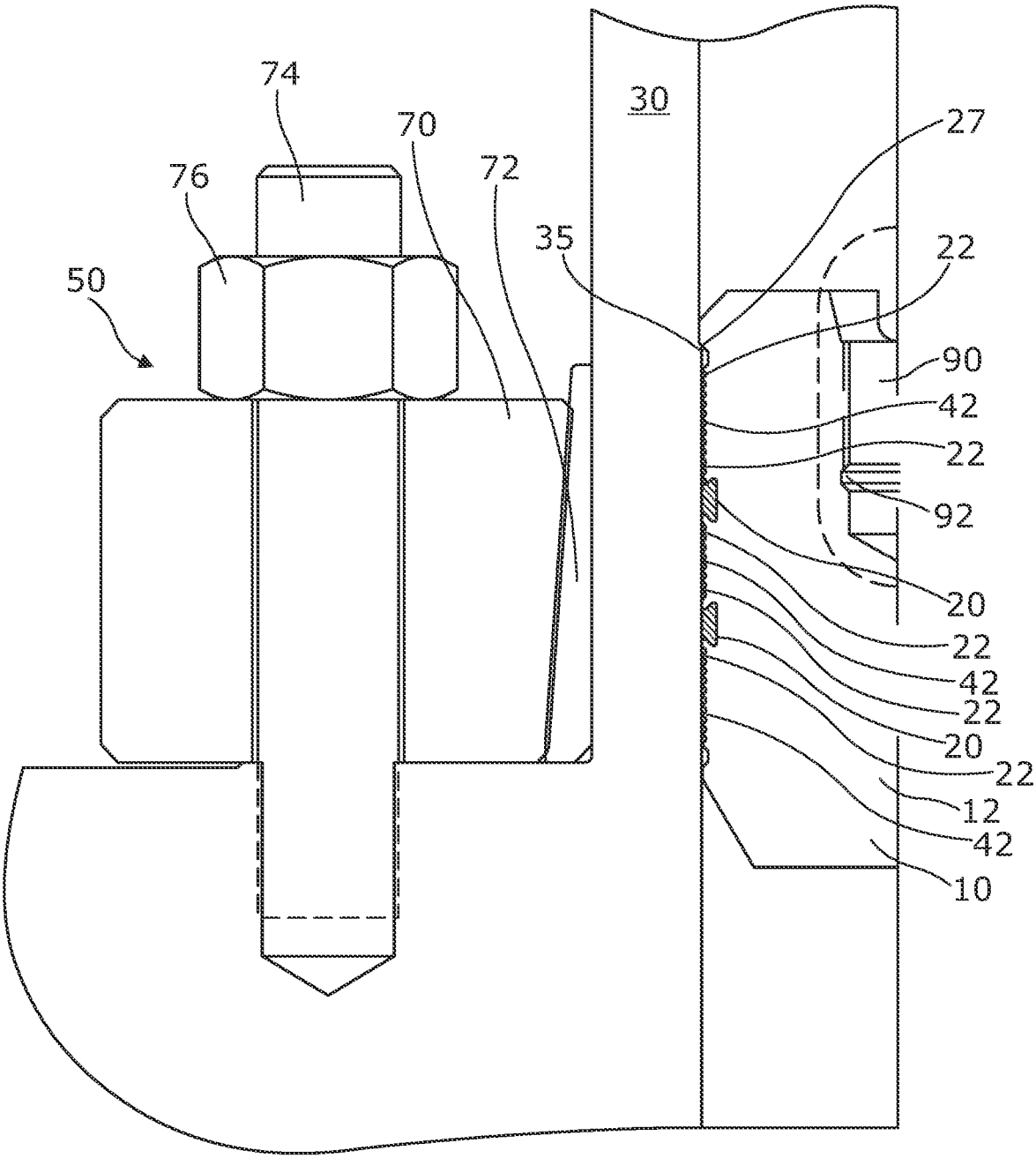
FIG. 3 is a detailed cross section of a crown plug and another embodiment of a securement system for a crown plug.
Figure 4:
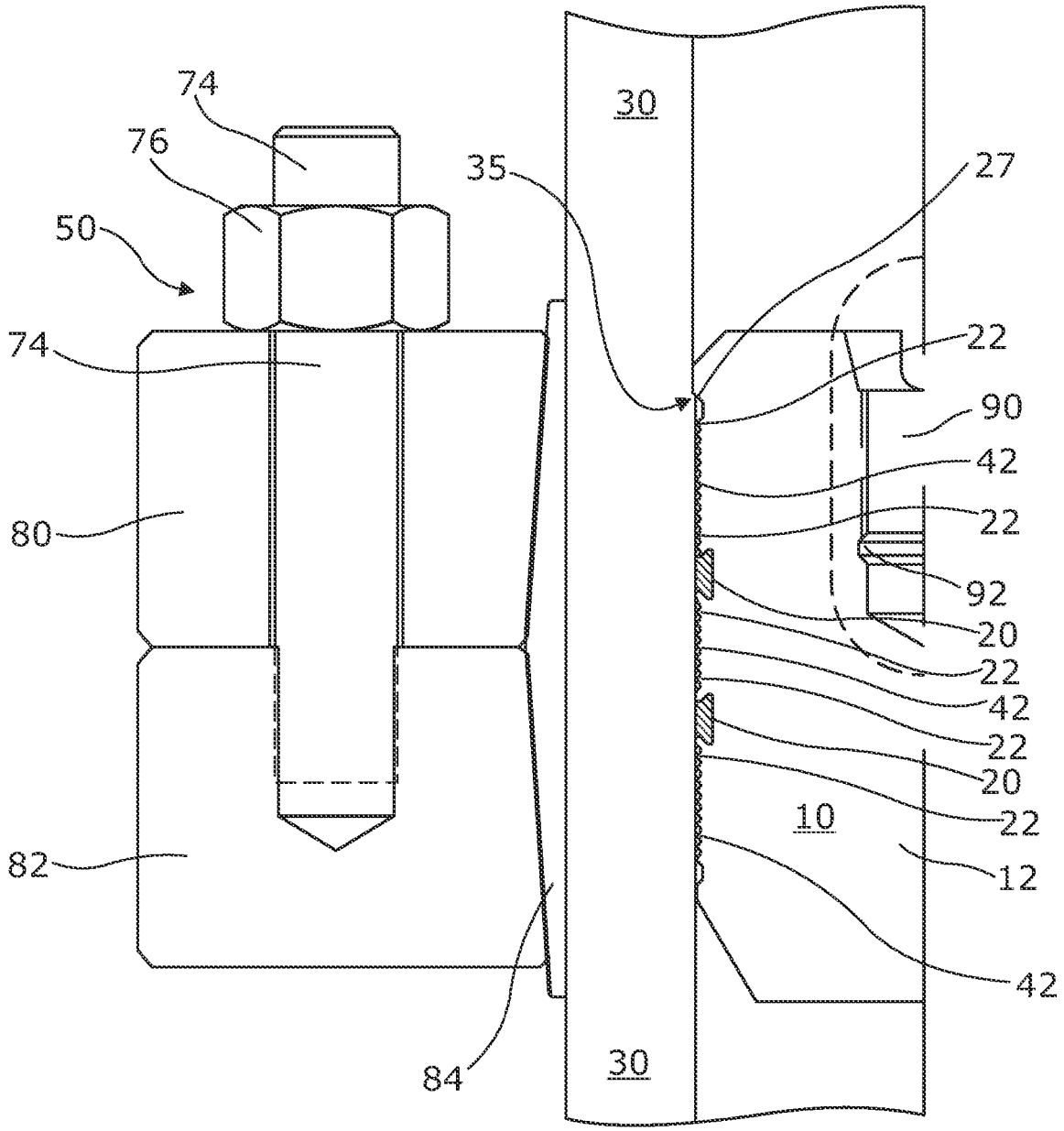
FIG. 4 is a detailed cross section of a crown plug and a further embodiment of a securement system for a crown plug.

In the preferred embodiment, the crown plug 10 comprises a cooperating alignment surface/shoulder 26 on a lower end or towards the lower end. However, in alternative embodiments, the cooperating alignment surface/shoulder may be provided on an upper end or towards the upper end of the crown plug 10. For example, an outwardly extending flange 27 may be provided at an upper end which is arranged to abut the shoulder 35, as shown in FIG. 3 and FIG. 4. In such an arrangement, the sealing surface(s) 14 of the crown plug 10 will locate below the shoulder 35. Further positions and locations for the cooperating alignment surface/shoulder 26 may be provided in alternative embodiments.

In the preferred embodiment, the lower end of the main body 12 of the crown plug 10 provides a cooperating alignment surface 26 (alignment shoulder). This alignment surface 26 comprises the lower edge of the main body 12. The lower edge of the main body 12 of the crown plug 10 comprises a chamfered or angled surface (shoulder 26) which engages and cooperates with the corresponding landing surface (shoulder 34) provided by the outer member 30.

The crown plug 10 is lowered down the production bore until the lower edge (alignment surface 26) of the main body 12 of the crown plug 10 abuts and rests on the alignment shoulder 34 provided in the outer member 30. This signifies the correct landing position for the crown plug 10. At this location, the clamping arrangement 50 can then be activated to energise the seal of the crown plug 10. The clamping force is maintained whilst the crown plug 10 is required. When access is required further down the production bore, the clamping force can be released and the crown plug 10 retrieved. This thereby opens up the production bore. The clamping arrangement can be subsequently reused to again secure a crown plug 10 within the production bore once the requirement for the access down the production bore has ceased.

The outer surface and, in particular, the sealing surface 14 of the crown plug 10 may be tapered. The tapered outer surface is arranged to be engaged/secured within a corresponding tapered portion of the outer member 30. In these embodiments, prior to activation of the clamping arrangement 50, the initial clearance between the inner surface 32 of the outer member 30 and the outer sealing surface 14 of the crown plug 10 is minimised.

As explained above, the clamping arrangement 50 distorts and deflects/compresses the outer member 30 inwardly in order to grip and secure the crown plug 10 within the bore. The outer member 30 is elastically deformed such that the outer member 30 will return towards the initial position once the clamping force is removed. Accordingly, to maintain these properties of the material of the outer member 30, the inward deflection distance is restricted and is not infinite. In a concentric axial bore, a first inward distortion distance may be required before the outer member 30 actually contacts the crown plug 10. Accordingly, this clamping force is ineffective and may be disregarded. In the embodiments with corresponding tapered surfaces, this initial distance contributes towards the gripping/sealing force and therefore this maximises the force capability of the clamping arrangement 50 in securing the crown plug 10 within the outer member 30.

Such a tapered configuration may also aid the axial alignment of the crown plug 10 by providing a predetermined landing zone within the outer member 30. The crown plug 10 is tapered inwardly and uniformly (with a shallow taper) from an upper portion to a lower portion such that the diameter of the crown plug 10 is greater at the upper portion than the lower portion. The upper portion may define or be located at or adjacent to the upper extent of the sealing surface 14. Similarly, the lower portion may define or be located at or adjacent to the lower extent of the sealing surface 14.

Accordingly, the present invention provides a new type of crown plug 10 that may be set using a POS-GRIP compression system which functions as the clamping arrangement 50. The crown plug 10 of the present invention comprises a one-piece solid crown plug 10 which results in easy installation and increased reliability compared to conventional crown plugs.

FIG. 1 shows a cross section of a POS-GRIP energised crown plug 10. As mentioned above, the crown plug 10 is a solid one-piece design and is set within the bore of the outer member 30, which may be either the tubing hanger neck, Christmas tree cap or Christmas tree body. There is no initial interference when the crown plug 10 is run, so the crown plug 10 is protected, and retrieval can be carried out by simple straight pull.

Figure 2:
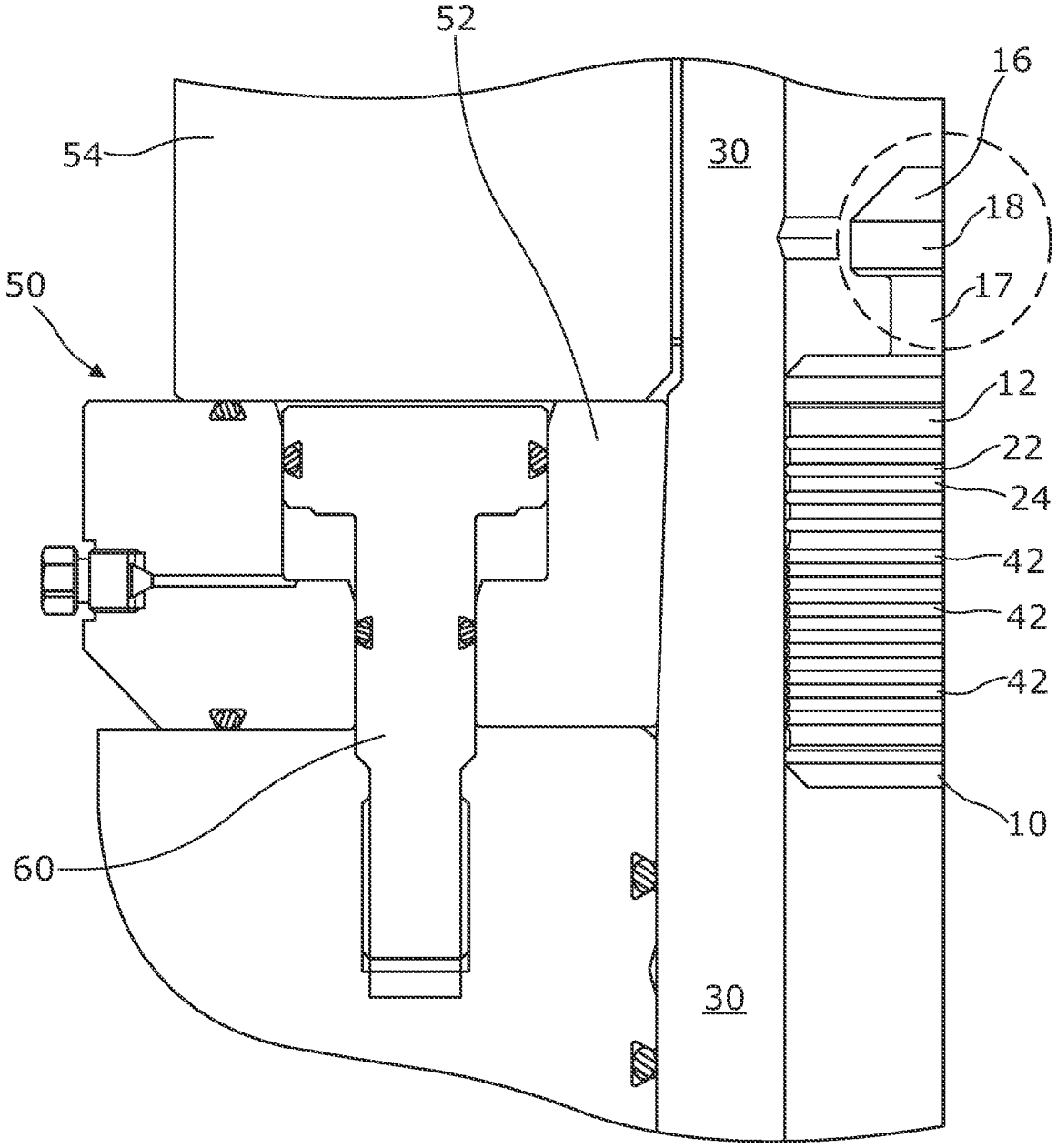
FIG. 2 is a detailed cross section of a crown plug located within a preferred embodiment of a securement system for a crown plug.

The crown plug 10 is energised by a POS-GRIP compression system, examples of which are shown in FIG. 2 to FIG. 4. The POS-GRIP compression system, when activated, causes the outer member 30 to elastically deflect onto the crown plug 10. This generates a contact pressure between the crown plug 10 and the outer member 30. The crown plug 10 has an integral metal to metal seal profile on the external diameter of the crown plug 10.

The contact pressure from the compression system energises the metal to metal seal and provides load support due to friction and/or shear strength of radial bumps 22 and/or gripping teeth 42 at the gripped surface 14. The POS-GRIP process is globally elastic. Accordingly, all the components operate within the elastic range and when the compression system is released the through bore of the outer member 30 returns to its original state. Thus, there is no interference between the crown plug 10 and the outer member 30 once the compression system has been released.

The bumps 22 and teeth 42 may be provided in the external diameter of the crown plug 30 to provide greater axial load capacity. The elastomeric seals 20 may also provide a back up to the metal to metal seal.

A tag shoulder 34 may be provided to the through bore of the outer member 30 to allow the crown plug 10 to positively land out in an optimal position with respect to the POS-GRIP compression system 50.

As shown in FIG. 2 to FIG. 4, possible different configurations of POS-GRIP compression system can be used to energise the crown plug 10. In all three configurations, a tapered interface between a solid compression ring 52 and body with matching taper is used to produce a radial (inward) displacement to energise the crown plug 10. This is achieved when the compression ring 52 is displaced axially which generates a radial load on the bodies inboard of the compression ring 52. The axial displacement of the compression ring 52 will preferably be achieved by integral pistons 60 or studded fasteners but may be achieved by other means.

A running/retrieval tool profile is integral to the crown plug 10 and may be configured to suit any type of tool. Two possible options are provided in FIG. 2 and FIG. 4. In FIG. 1 and FIG. 2, the attachment member 16 projects upwardly with a neck portion 17 and a head portion 18. However, in FIG. 3 and FIG. 4, the attachment member comprises an attachment recess 90 into which a part of the running tool can project and thereby engage the crown plug 10. This recess 90 may provide an engagement groove 92 within a cylindrical recess. Again, this eliminates the use of any moving/articulating parts on the crown plug 10.

FIG. 2 shows a single compression ring POS-GRIP compression system where the tapers are integral to the compression ring 52 and the outer member 30. The means to axially displace the compression ring 52 is shown as a hydraulically functioned integral pistons 60. However, this may be achieved by other means. The POS-GRIP compression system provides the energy required to compress the outer member 30 to energise the crown plug 10.

The upper reaction ring 54 is used to prevent the compression ring 52 from backing off once hydraulic pressure has been released. However, the compression ring 52 may be retained by other means.

In FIG. 2, the rounded ridges (radial bumps) 22 are located on an upper portion of the sealing surface 14. The angled ridges (gripping teeth) 42 are provided on a lower portion of the sealing surface 14.

FIG. 3 shows a single compression ring POS-GRIP compression system where the tapered interface on the compression ring 70 bears against a matching taper on a split collar 72 positioned between the compression ring 70 and the outer member 30. When the compression ring 70 is displaced axially, the split collar 72 is displaced inwards generating a radial load on the outer member 30 which energises the crown plug 10.

The means to axially displace the compression ring 70 is shown as studded fasteners 74 which may be functioned using hydraulic tensioners or a torque tool. However, this may be achieved by other means. If studded fasteners 74 are used, then nuts 76 as shown are typically used to prevent the compression ring from backing off. As mentioned above, an upper (landing/index) shoulder 35 and index/aligning surface 27 are used in this embodiment.

In FIG. 3, single rounded ridges (radial bumps) 22 are located immediately adjacent to the sealing members 20 and preferably at the upper most and lowermost positions of the sealing surface 14. The angled ridges (gripping teeth) 42 are provided in between the rounded ridges 22 of the sealing surface 14.

FIG. 4 shows a dual compression ring POS-GRIP compression system where two compression rings 80, 82 bear against matching tapers on a split collar 84 positioned between the compression rings 80, 82 and the outer member 30. The means to axially displace the compression ring can be achieved by hydraulic tensioners, torque tool or other means. As mentioned above, an upper (landing/index) shoulder 35 and index/aligning surface 27 are used in this embodiment.

In FIG. 3, single rounded ridges (radial bumps) 22 are located immediately adjacent to the sealing members 20 and preferably at the upper most and lowermost positions of the sealing surface 14. The angled ridges (gripping teeth) 42 are provided in between the rounded ridges 22 of the sealing surface 14.

The present invention uses a clamping arrangement 50 to elastically deflect an outer member 30 to lock and activate seals on a crown plug 10. In the primary application of this invention, the outer member 30 is a Christmas tree body, Christmas tree cap or tubing hanger body.

The crown plug 10 provides similar functionality as conventional plugs but offers a more reliable means to set and release as well as a high quality metal to metal seal. The crown plug 10 does not rely on pressure or slickline jarring to set or release unlike conventional plugs. The crown plug 10 is a one component design which removes the complex interaction of moving parts within the wellbore which can lead to problems setting or retrieving. Thus, no latches or dogs are required to set. The components used to set or retrieve the crown plug 10 are external, meaning all moving parts used to set are accessible and maintainable.

Multiple instances of this design can be used in series (upper and lower crown plugs) to provide multiple barriers to a well bore.

Overall, the present invention relates to the use of POS-GRIP technology to energise a crown plug 10 to provide load support and sealing within an outer member 30 such as a tubing hanger or Christmas tree. A one-piece solid crown plug design improves reliability to set and release. The present invention results in high lockdown capacity achieved by POS-GRIP technology. In addition, the present invention comprises a high quality primary metal to metal seal. Furthermore, elastomer seals 20 provides back-up for the primary metal to metal seal.

The invention claimed is:

1. A crown plug securement system comprising an outer member of a bore, a crown plug and a securement device to secure the crown plug within the outer member, the securement device comprising a clamping arrangement actuatable between a first configuration and a second configuration, wherein, in the first configuration, a clamping member is in an unclamped configuration and enables the crown plug to be axially moved within the outer member to an axial position which is aligned with the clamping member of the clamping arrangement and, in the second configuration, the clamping arrangement exerts sufficient radial force on the outer member to distort the outer member inwardly to grip the crown plug and secure the crown plug in the axial position within the bore, in which the crown plug comprises a unitary component including a one-piece component and in which in changing from an unclamped position to a clamped position the crown plug solely requires positioning at the clamped position without any manipulation of any securement elements located on the crown plug, wherein the crown plug is solely secured in position by the clamping arrangement and the crown plug is solely secured in position by movement of elements located externally of the outer member, in which the crown plug comprises a main body arranged to create a barrier across the outer member, and wherein the main body comprises a solid body providing a bung which fills the outer member within a sealing zone and wherein the sealing zone extends along an axial length of the outer member.

2. The crown plug securement system according to claim 1, wherein the crown plug and the outer member create a metal to metal seal in the second configuration.

3. The crown plug securement system according to claim 2, wherein the crown plug and the outer member create a full circumferential metal to metal seal in the second configuration.

4. The crown plug securement system according to claim 1, wherein the crown plug comprises an outer sealing surface comprising a metal sealing surface and an elastomeric seal.

5. The crown plug securement system according to claim 1, wherein the crown plug comprises an outer sealing surface comprising a profiled sealing surface, wherein the profiled sealing surface comprises a series of full circumferential rounded ridges extending around the outer sealing surface, and wherein adjacent rounded ridges are separated by full circumferential recesses.

6. The crown plug securement system according to claim 5, wherein the outer sealing surface comprise an upper array of the rounded ridges and a lower array of the rounded ridges and wherein the upper array of the rounded ridges locate on an upper portion of the crown plug and above a sealing member and the lower array of the rounded ridges locate on a lower portion of the crown plug and below the sealing member.

7. The crown plug securement system according to claim 5, wherein the profiled sealing surface comprises a second series of axially spaced apart ridges comprising a series of full circumferential angled ridges extending around the outer sealing surface, and wherein adjacent angled ridges are separated by full circumferential recesses.

8. The crown plug securement system according to claim 1, wherein the outer member comprises an index shoulder which is arranged, in use, to cooperate with an index surface on the crown plug in order to align the crown plug relative to the clamping arrangement.

9. The crown plug securement system according to claim 8, wherein the index surface of the crown plug is provided by a lower annular surface which is provided around a lower outer edge of the crown plug the face panel of the glazing unit and the secondary face panel of the secondary unit.

10. The crown plug securement system according to claim 1, wherein an outer sealing surface of the crown plug is tapered and, and wherein the tapered outer sealing surface of the crown plug cooperates with a respective tapered portion of the outer member.

11. The crown plug securement system according to claim 1, Wherein the crown plug comprises a tool attachment member.

12. The crown plug securement system according to claim 11, wherein the tool attachment member is located on an upper surface of the crown plug.

13. The crown plug securement system according claim 12, wherein the tool attachment member comprises a lug extending upwardly away from an upper surface of a main body of the crown plug.

14. The crown plug securement system according to claim 12, wherein the tool attachment member comprises a recess extending inwardly into the crown plug.

15. The crown plug securement system according to claim 1, wherein, in the first position, an outer sealing surface of the crown plug is arranged to locate at a longitudinal position in which an outer sealing surface is movable relative to an inner surface provided in the outer member in order to enable the crown plug to move within the outer member.

16. The crown plug securement system according to claim 1, wherein the clamping arrangement comprises a collar having an externally tapered surface, the arrangement may also include an annular component with an internally tapered surface and wherein the collar and the annular component are relatively axially moveable between a first position the tapered surface of the annular component exerts no radial force on the collar and a second position which the tapered surface of the annular component exerts sufficient radial force to distort the collar inwardly to grip the crown plug.

17. A wellhead including a securement system for securing a crown plug within the wellhead, the securement system being in accordance with claim 1.

18. A method of securing a crown plug within a wellhead comprising the step of activating a securement device to secure the crown plug within an outer member of a bore, wherein the securement device comprises a clamping arrangement, the step of activating the securement device comprising activating the clamping arrangement between a first configuration and a second configuration, wherein, in the first configuration, a clamping member is in an unclamped configuration and enables the crown plug to be axially moveable within the outer member to an axial position which is aligned with the clamping member of the clamping arrangement and, in the second configuration, the clamping arrangement exerts sufficient radial force on the outer member to distort the outer member inwardly to grip the crown plug and secure the crown plug in the axial position within the bore, wherein the crown plug comprises a unitary component including a one-piece component and wherein in changing from an unclamped position to a clamped position the crown plug solely requires positioning at the clamped position without any manipulation of any securement elements located on the crown plug, wherein the crown plug is solely secured in position by the clamping arrangement and the crown plug is solely secured in position by movement of elements located externally of the outer member, wherein the crown plug comprises a main body which is arranged to create a barrier across the outer member, wherein the main body comprises a solid body and the solid body provides a bung which fills the outer member within a sealing zone, and wherein the sealing zone extends along an axial length of the outer member.

* * * * *